US005259828A

United States Patent [19]

Schlieperskoetter

[11] Patent Number: 5,259,828

[45] Date of Patent: Nov. 9, 1993

[54] WORM CENTRIFUGE

[75] Inventor: Bernd Schlieperskoetter, Neunkirchen-Seelscheid, Fed. Rep. of Germany

[73] Assignee: Kloeckner-Humboldt-Deutz AG, Fed. Rep. of Germany

[21] Appl. No.: 843,400

[22] Filed: Feb. 28, 1992

[30] Foreign Application Priority Data

Feb. 28, 1991 [DE] Fed. Rep. of Germany ..... 4106276

[51] Int. Cl.[5] ..... B04B 1/20

[52] U.S. Cl. ..... 494/38; 494/56

[58] Field of Search ..... 192/107 R; 210/380.1, 210/380.3; 277/223, 224, 235, 199; 384/138, 280, 297, 907.1; 494/38, 50-56, 41

[56] References Cited

U.S. PATENT DOCUMENTS

| | | | |
|---|---|---|---|
| 3,148,145 | 9/1964 | Reed | 494/53 |
| 3,854,658 | 12/1974 | Probstmeyer | 494/53 |
| 3,885,734 | 5/1975 | Lee | 494/56 |
| 3,937,317 | 2/1976 | Fleury | 494/54 |
| 3,955,756 | 5/1976 | Hiller | 494/53 |
| 4,006,855 | 2/1977 | Merzenich | 494/54 |
| 4,295,600 | 10/1981 | Saget | 494/53 |
| 4,303,192 | 12/1981 | Katsume | 494/53 |
| 4,326,614 | 4/1982 | Matagrano | 192/107 R |
| 4,416,656 | 11/1983 | Shapiro | 494/53 |
| 4,950,219 | 8/1990 | Luchetta | 494/56 |

FOREIGN PATENT DOCUMENTS

| | | | |
|---|---|---|---|
| 3928744 | 8/1988 | Fed. Rep. of Germany | 494/53 |
| 2075870 | 11/1981 | United Kingdom | 494/56 |

*Primary Examiner*—Harvey C. Hornsby
*Assistant Examiner*—Terrance R. Till
*Attorney, Agent, or Firm*—Hill, Steadman & Simpson

[57] ABSTRACT

A worm centrifuge having a rotatable drum and a rotatable worm therein each independently rotatable at different speeds, adjustable weir plates at one end on the drum adjacent liquid fraction discharge openings, a ring seal including first and second rings in the region of the liquid discharge openings with one ring on the worm and the other ring on the drum, annular anti-wear protection segments on the seal ring on the auger with the segments on carriers which are removable through an end wall of the drum for replacement and for assimilating wear of material flowing through the liquid discharge openings wherein the wear on the seal ring rotating with the conveyor worm is avoided due to the anti-wear protection segments detachably joined to the seal ring.

11 Claims, 2 Drawing Sheets

WORM CENTRIFUGE

BACKGROUND OF THE INVENTION

The invention relates to improvements in rotary worm centrifuge separators, particularly of the solid bowl type having an independently rotatable worm therein wherein a slurry fed to the centrifuge is separated in a solids fraction and a liquids fraction.

More particularly, the invention relates to an improvement in the structure for the discharge of the liquid fraction.

Adjustable weir plates are provided at liquid discharge openings arranged in the end wall of the centrifuge drum. A ring seal is arranged in the region of the liquid discharge openings between the worm supporting member of the conveyor worm and the centrifuge drum. The ring seal is constructed of two rings wherein one ring seal is supported on and is rotated with the centrifuge drum and the other ring seal is joined to the conveyor worm to rotate therewith. The ring seal rotating with the conveyor worm is provided with anti-wear protection at its annular surface facing toward the liquid discharge openings.

In worm centrifuges of the type above described which have heretofore been known, a collecting space is provided for the liquids separated from the solids which forms during the operation of the centrifuge. This liquid collects between the outer weir plate arranged at the end wall of the drum and the ring seal which is arranged at the worm supporting member of the conveyor worm. This collecting space is sealed from the separating space by a ring seal. It has proven to be unavoidable that the deposits of solids in the liquid collecting space arise during the course of operation of the centrifuge. These deposits cause increased wear at the ring seal arranged at the worm supporting member which rotates at a speed different than that of the centrifuge drum. This wear at the seal ring can lead to leaks in the ring seal so that part of the liquid not yet separated from the solids can proceed from the separating space of the drum into the liquid collecting space. The separating power then is deteriorated or detracted from as a result of this wear. This results in the necessity of the operator removing the worm supporting member from time to time to replace the seal ring. This involves comparatively substantially great outlay in terms of work, time and cost since the drum must be opened for this purpose and the worn seal ring must be removed or must be replaced by a new one.

It is accordingly an object of the present invention to provide an improved centrifugal drum separator structure which has the capability of avoiding the wear at the seal ring of the ring seal which is located between the conveyor worm at the liquid discharge region of a worm centrifuge.

A still further object of the invention is to provide a structure wherein if wear occurs in the seal ring, then the structure is so arranged that the worn parts can be quickly and easily removed and replaced without necessitating the substantial disassembly and work which was necessary in structures heretofore available.

FEATURES OF THE INVENTION

In accordance with the invention, seal rings are provided with a first seal ring rotating with the drum of a centrifugal separator and the second seal rotating with the conveyor worm. The second ring rotating with the conveyor worm has its annular surface facing toward the liquid discharge openings in the end wall of the centrifuge drum. This annular surface is provided with anti-wear protection that is composed of highly wear-resistant annular segments that are detachably connected to the seal ring. As a result of this detachable connection of the highly wear-resistant annular segments, a particular advantage is achieved in that substantial wear is resisted but if wear occurs, only the annular segment need be removed and replaced but not the seal ring. A further advantage is achieved in providing the anti-wear protection in the form of annular segments in that the individual annular segments can be easily built in and removed from the outside of the drum through liquid discharge openings in the end wall of the centrifuge drum and through a appropriate assembly opening in the housing wall of the centrifuge.

In accordance with the invention, the annular segments are fashioned as carrier elements wherein highly wear-resistant plates are firmly arranged on the carrier element and the carrier elements are in turn detachably connected to the seal ring which rotates with the conveyor worm. This plate shaped fashioning and arrangement of the highly resistant plates on the carrier elements has the particular advantage that individual plates can be removed from the carrier elements outside the centrifuge as needed and can be replaced by new ones without having to replace the carrier element every time. The fastening of the highly resistant plates to the carrier element can occur in a simple way such as by welding, soldering, cementing or like attachment.

Other advantages, features and objects will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
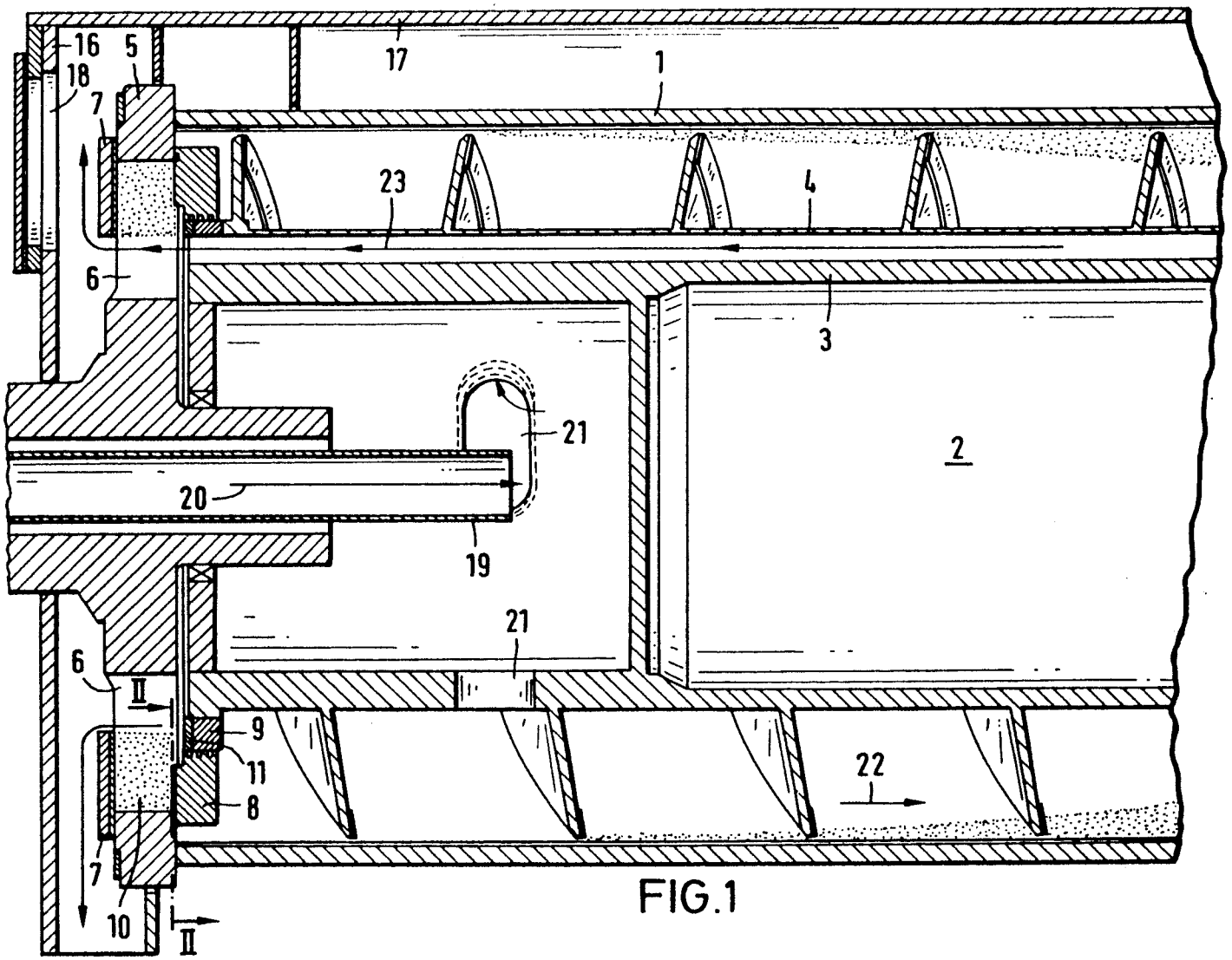
FIG. 1 is a fragmentary vertical sectional view taken through the axis of a solid bowl worm centrifuge employing seal rings in accordance with the principles of the present invention.

As illustrated in FIG. 1, a conveyor worm 2 is coaxially arranged within a centrifuge drum 1 of a solid bowl worm centrifuge. It will be understood that the solid bowl worm centrifuge admits a slurry at one end, performs a separation function to divide the slurry into a liquids fraction and a solids fraction with the solid fraction moving to the right in the drawing, moved by the auger of the worm. Inasmuch as the overall operation of the centrifuge is well known by those versed in the art, the present drawings only show the liquid fraction removal end and it will be understood that other well-known structures of centrifuges are incorporated herein by reference.

Within the drum 1, a worm supporting member is shown at 3 which is hollow being provided with axial channels 4 uniformly distributed over the circumference. These channels are provided for withdrawing the liquid separated from the solids within the drum 1.

Liquid discharge openings 6 are provided and the overflow level for these openings can be set by weir plates 7 arranged at the outside at the end wall 5 of the centrifuge drum. These weir plates are adjustably secured to the end wall 5 of the centrifuge drum and are uniformly distributed around the circumference of the drum.

A ring seal is located inside the end wall 5 lying opposite the weir plates 7. The ring seal is composed of a first ring 8 and a second ring 9. The sealing ring 8 is detachably connected to the centrifuge drum and rotates therewith. The sealing ring 9 is detachably connected to the worm supporting member 3 of the conveyor worm 2 and rotates therewith.

The seal which is composed of the two rings 8 and 9 is fashioned as a labyrinth seal and prevents an emergence of the liquid that has not yet been separated from the solids in the centrifuge drum and has not yet passed into the collecting space 10 situated between the weir plates 7 and the labyrinth seal.

Figure 2:
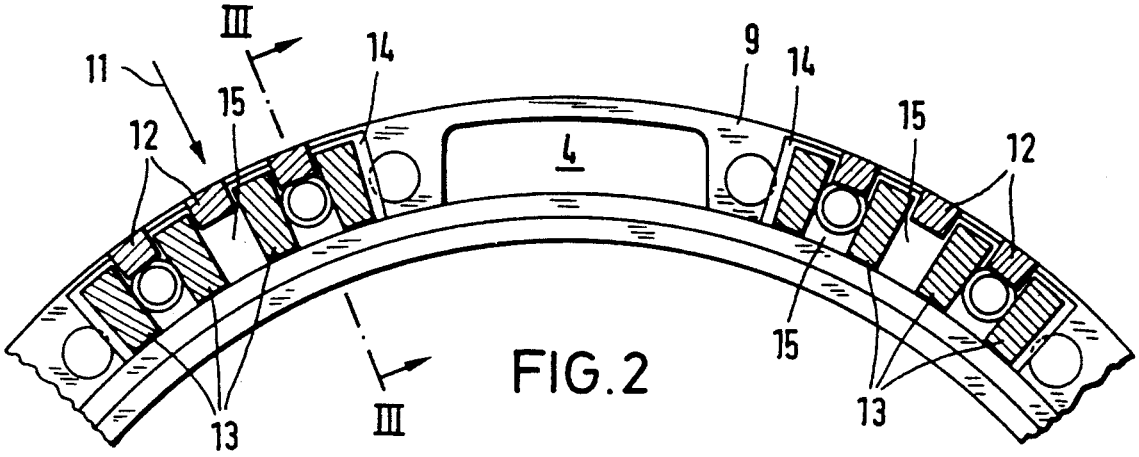
FIG. 2 is a sectional line taken substantially along line II—II of FIG. 1.
Figure 4:
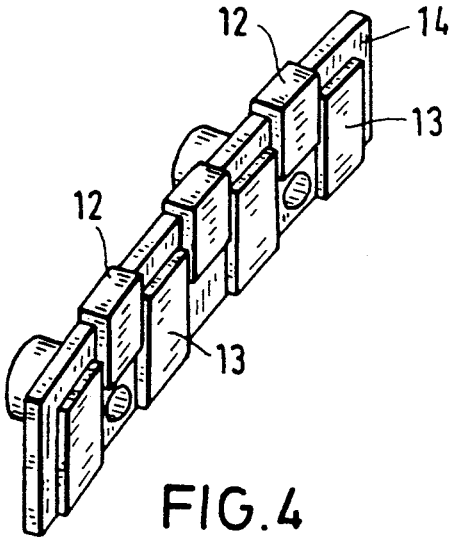
FIG 4 is a perspective view illustrating the features of FIGS 2 and 3.
Figure 3:
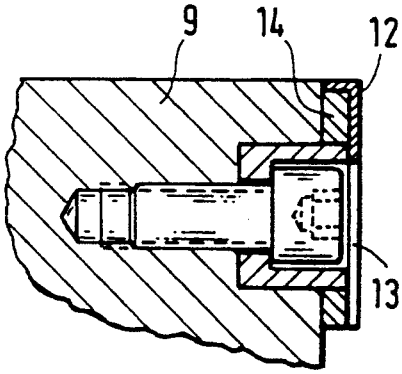
FIG. 3 is a sectional view taken substantially along line III—III of FIG. 2.

In accordance with the invention, the sealing ring 9 which rotates with the conveyor worm is provided with anti-wear protection 11 at the side facing toward the liquid openings. As shown in FIGS. 2 and 3, the anti-wear protection 11 is composed of highly wear-resistant plates 12 and 13 that are firmly arranged on a carrier element 14. This carrier element is shaped as annular segment and is in turn detachably connected to the seal ring 9 such as by removable screws.

As FIG. 3 illustrates, the highly wear-resistant plates 12 are angularly or L-shaped fashioned in cross-section, and as a result of that shaping, particularly the outside edge of the seal ring of the labyrinth seal is protected against wear.

The highly wear-resistant plates 12 and 13 are arranged circumferentially offset relative to one another and are respectively secured to the annular shaped carrier element 14 such as by welding, soldering or cementing. The annular segment shaped carrier elements 14 can also be provided with a highly wear resistant protective layer such as by built-up welding, and will be detachably connected to the seal ring 9 yielding the same advantages as the wear-resistant segments.

The highly wear-resistant plates 12 and 13 are arranged offset relative to one another in a circumferential direction, mounted on the annular shaped carrier 14 and have the advantages that solids can settle during the course of operation of the centrifuge in the clearances 15 between the plates 12 and 13. This further acts to prevent wear and creates turbulences which are a consequence of the different circumferential speed that the conveyor worm with the seal ring 9 causes during operation relative to the rotation of the centrifugal drum 1 which has a seal ring 8. These turbulences between the seal ring 9 and the end wall 5 of the drum prevent deposits of solids and cakings in this region. The annular shaped carrier segments 14 are mounted in any suitable manner for removal when wear occurs to the wear plates 12 and 13. For example, the segmental carrier elements 14 may be provided with openings for admission of screws or bolts 25 threaded into the seal ring 9.

Due to the differential speed of the conveyor worm compared with the centrifugal drum 1 during the operation of the centrifuge, the seal ring 9 is exposed to elevated wear due to the solids deposited in the collecting space 10 over the course of operation. The seal ring 9 rotating with the worm 2 is protected against wear by the highly wear-resistant annular segments that are detachably arranged at that location. As needed, only the worn annular segments need be replaced by new ones but not the seal ring 9.

Both the assembly as well as disassembly of these segments can occur from the outside of the drum with comparatively little outlay for work, time and costs. This is accomplished through the liquid discharge opening 6 in the end wall of the centrifuge drum and through an assembly opening 18 which is located in an end wall 16 of the centrifugal housing 17. The opening 18 has a suitable cap over the opening which is removably attached for access to the space within the end wall 16. The liquid discharge openings 6 which are in the end wall of the drum 1, are arranged at the circumferential level of the sealing ring 9 so that the wear-resistant annular carrier segments can be easily inserted and removed from the outside through the liquid openings 6.

During operation of the solid bowl worm centrifuge shown in the drawings, the solids liquid mixture provided for dewatering is supplied to the centrifuge in the direction indicated by the arrow 20 through the opening 21 in the worm supporting member 3 through a suitable conduit 19. The separation of the solids from the liquid occurs within the centrifugal drum and the solids are discharged to the outside in the direction of the arrow 22 pointing to the right in the drawing. The solid fraction will be discharged through openings not shown, but of conventional construction in known centrifuges. The liquid separated from the solids is discharged to the left toward the outside in an arrow direction 23 flowing through the channels 4 through the openings 6 in the end wall 5 of the drum.

It will be understood that the construction of the centrifuge in accordance with the principles of the invention may take various forms employing the concepts above set forth. The highly wear-resistant annular segments provided with the highly wear-resistant plates can be detachably connected to the worm supporting member in order to protect the conveyor worm and its seal ring against wear in the region of the liquid discharge openings. Highly wear-resistant plates of sintered metal or ceramic are particularly suitable as anti-wear protection.

I claim as my invention:

1. A worm centrifuge separator of the solid bowl type having a coaxially arranged worm in a drum rotatable at a speed different than the drum and having a slurry inlet and a solids fraction outlet with a plurality of annularly arranged circumferentially separated liquid fraction outlet openings comprising in combination:

weir plates mounted on an end wall of a drum;

a ring seal located at liquid fraction discharge openings in the end wall having a first ring connected to the drum to rotate therewith and a second ring connected to rotate with a separator worm;

and anti-wear protection on the annular surface of the second ring facing said liquid fraction discharge openings comprised of highly wear-resistant annular segments detachably connected to the second ring so that said second ring is protected against abrasive solids between the circumferentially separated liquid openings.

2. A worm centrifuge separator of the solid bowl type having a coaxially arranged worm in a drum rotatable at a speed different than the drum and having a slurry inlet and a solids fraction outlet and a plurality of annularly arranged circumferentially separated liquid fraction outlet openings constructed in accordance with claim 1:

wherein the annular segments provide carrier elements with wear-resistant plates firmly attached thereto and the carrier elements are attached to said second seal ring for rotating together with the conveyor worm.

3. A worm centrifuge separator of the solid bowl type having a coaxially arranged worm in a drum rotatable at a speed different than the drum and having a slurry inlet and a solids fraction outlet and a plurality of annularly arranged circumferentially separated liquid fraction outlet openings constructed in accordance with claim 1:

wherein the wear-resistant segments are arranged circumferentially offset from each other supported on a element.

4. A worm centrifuge separator of the solid bowl type having a coaxially arranged worm in a drum rotatable at a speed different than the drum and having a slurry inlet and a solids fraction outlet and a plurality of annularly arranged circumferentially separated liquid fraction outlet openings constructed in accordance with claim 3:

wherein the wear-resistant plates are formed of ceramic.

5. A worm centrifuge separator of the solid bowl type having a coaxially arranged worm in a drum rotatable at a speed different that the drum and having a slurry inlet and a solids fraction outlet and a plurality of annularly arranged circumferentially separated liquid fraction outlet openings constructed in accordance with claim 4:

wherein said ceramic is a sintered ceramic.

6. A worm centrifuge separator of the solid bowl type having a coaxially arranged worm in a drum rotatable at a speed different than the drum and having a slurry inlet and a solids fraction outlet and a plurality of annularly arranged circumferentially separated liquid fraction outlet openings constructed in accordance with claim 1:

wherein said liquid fraction opening is in radial alignment with the second ring and ports are located in an end wall of the drum for removal and replacement of said annular segments.

7. A worm centrifuge separator of the solid bowl type comprising in combination:

an outer shell solid drum centrifugal separator for being rotated in rotation about a central axis;

a worm located therein arranged for being rotated independently of the solid drum at a speed different than the drum;

an axial inlet for admitting slurry to the axial center of the drum;

radially spaced circumferential separated openings at one end of the drum;

weir plates mounted relative to said openings on an end wall of the drum a first ring seal supported on the drum for rotation therewith;

a second ring seal mounted on the worm for rotation therewith coacting with the first ring seal with openings through the ring seal for the discharge of a liquid fraction separated within the drum with abrasive solids tending to collect radially outwardly of the openings at the ring seal;

and annular carrier segments on the second ring seal having wear-resistant segments admitting liquid through the openings with said segments protecting said second ring seal.

8. A worm centrifuge separator of the solid bowl type constructed in accordance with claim 7:

wherein said carrier elements are removable with the wear-resistant elements for replacement thereof.

9. A worm centrifuge separator of the solid bowl type constructed in accordance with claim 8:

including opening ports in an end wall of the drum for axial removal of the carrier segments.

10. A worm centrifuge separator of the solid bowl type constructed in accordance with claim 7:

including L-shaped holders for the anti-wear protective segments supporting the segments on the carrier elements.

11. A worm centrifuge separator of the solid bowl type comprising in combination:

an outer shell solid bowl centrifugal separator for being rotated in rotation about a central axis;

a worm located therein arranged for being rotated independently of the solid bowl at a speed different than the bowl;

an axial inlet for admitting slurry to the axial center of the drum;

an end weir mounted on the drum and providing a space axially inwardly of the weir for collection of a liquid fraction separated from a slurry within the drum;

a seal having a first seal ring rotatable with the drum and a second seal ring rotatable with the worm;

and a plurality of carriers having wear-resistant separated elements on the second ring generating turbulence with the difference in circumferential speed between the worm and the drum aiding in preventing the deposit of solids and cakings in the region of the rings.

* * * * *